United States Patent [19]

Tiggelbeck et al.

[11] 3,972,335

[45] Aug. 3, 1976

[54] MENTHOLATED CIGARETTE FILTER

[75] Inventors: Donald David Tiggelbeck, Pittsburgh, Pa.; Milton Manes, Kent, Ohio

[73] Assignee: Calgon Corporation, Pittsburgh, Pa.

[22] Filed: Dec. 4, 1975

[21] Appl. No.: 637,610

Related U.S. Application Data

[63] Continuation-in-part of Ser. No. 290,683, Sept. 20, 1972, abandoned, which is a continuation of Ser. No. 61,851, Aug. 6, 1970, abandoned.

[52] U.S. Cl. ..... 131/267

[51] Int. Cl.[2] ..... A24D 1/06

[58] Field of Search ..... 131/261, 267, 17 R, 131/17 X, 200, 265, 10.9, 10.7

[56] References Cited

UNITED STATES PATENTS

| | | | |
|---|---|---|---|
| 1,451,235 | 4/1923 | Raje | 131/267 UX |
| 3,144,024 | 8/1964 | Eichwald | 131/17 R X |
| 3,344,796 | 10/1967 | Yamaji et al. | 131/261 R |
| 3,400,032 | 9/1968 | Sexton et al. | 131/267 UX |
| 3,443,566 | 5/1969 | Yasuda | 131/267 |
| 3,531,558 | 9/1970 | Ganz | 131/267 X |
| 3,552,400 | 1/1971 | Berger | 131/261 |

FOREIGN PATENTS OR APPLICATIONS

| | | | |
|---|---|---|---|
| 173,262 | 5/1952 | Austria | 131/200 |

*Primary Examiner*—Robert W. Michell
*Assistant Examiner*—V. Millin
*Attorney, Agent, or Firm*—Harry E. Westlake, Jr.; Raymond M. Speer

[57] ABSTRACT

A cigarette filter containing menthol or other smoke-flavoring agent, and having improved shelf life and delivery rates for the smoke-flavoring agent, is obtained by first impegnating a granular activated carbon with a pore-modifying agent capable of blocking the most retentive portions of the activated carbon, by being held in preference to the smoke-flavoring agent which is added later. The pore-modifying agent is employed in amounts such that the less retentive portions of the activated carbon are not blocked but remain available for adsorption of the smoke-flavoring agent. A preferred pore-modifying agent is sucrose. Subsequently, the activated carbon is impregnated with the smoke-flavoring agent. The granular activated carbon is then formed into a filter.

13 Claims, No Drawings

MENTHOLATED CIGARETTE FILTER

This application is a continuation-in-part application of copending Application Ser. No. 290,683, filed Sept. 20, 1972 and now abandoned, which in turn was a continuation application of Application Ser. No. 61,851, filed Aug. 6, 1971, and now abandoned.

BACKGROUND OF THE INVENTION

Mentholated cigarettes, particularly filtered varieties, have enjoyed increased popularity and now account for more than 20 percent of the total market in the United States, together with varying percentages of penetration in overseas markets. Most commonly, menthol is applied to tobacco as a concentrated menthol/ethanol spray and is volatilized when the cigarette is smoked. In some countries in which tobacco is taxed by weight, the menthol is applied to the paper making up the cigarette package and subsequently migrates to the tobacco during storage. Both these approaches, which place menthol on tobacco, have several inherent disadvantages. One is that, as the cigarette is smoked, about three-fourths of the menthol on the tobacco is lost to the "side stream" smoke and is unavailable for taste effect to the smoker. A second disadvantage is that during storage and distribution of cigarettes to ultimate retail outlets, varying amounts of menthol are lost from the tobacco through the package. Most cigarettes are between six weeks to four months old when they are finally smoked. undergoing different storage conditions depending on season and other factors, so that the resultant uniformity of mentholated cigarettes is much lower than would be desired.

Activated carbon is known to be a highly efficient cigarette filter material, particularly for gas phase components of the smoke which have been shown to be toxic. However, it has not found significant commercial use in mentholated cigarettes since, among other reasons, activated carbon adsorbs the greater part of the menthol before the menthol can be delivered from its original place on the tobacco to the smoker. In adsorbing the menthol, the carbon's ability to adsorb the undesirable components of the smoke is diminished.

The disclosure of Irby U.S. Pat. No. 3,236,244 is an example of the use of activated carbon as a carrier for menthol for its introduction to the smoke stream. This type of filter does not, even during smoking, deliver a large part of the menthol at all. The menthol tenaciously clings to the carbon, clogging the pores and rendering the filter very inefficient with respect to the smoke stream. Only about one-fifth of it is recovered to the smoker. Because the carbon is so heavily loaded with menthol, a substantial portion of the menthol is also lost during storage. And, the Irby filter releases comparatively more menthol on the first puffs than the last. Furthermore, the Irby invention is workable only with a large available outer surface area of activated carbon, and thus requires the use of a very fine granular activated carbon material that is nearly a powder. This fine granular carbon, which if used in significant quantity, is difficult to handle in manufacturing the filter, limits the filter designs which may be used, and may cause an undesirable pressure drop. A commercial embodiment of the Irby invention was available for about six years, but commercialization has since been abandoned.

In addition to menthol, other flavor ingredients for cigarettes have been included either as components of filters or as additives to the tobacco upstream of the filter. One such embodiment is disclosed in Eichwald et al. U.S. Pat. No. 3,144,024, which discloses the use of various flavoring agents, including sugars, in cigarettes using mainly cellulosic filters but also contemplating "charcoal" filters. It is not suggested by Eichwald et al. however, that any advantage may be obtained by a particular combination of the use of sugars and menthol, either in the filter or on activated carbon. The sugar, in other words, is contemplated as a flavoring agent in itself. The use of sugar in the present invention, as amplified below, is basically as a convenient, comparatively inexpensive, food grade material to modify the pore structure of activated carbon. This modifying agent is not released as a flavoring agent as in the method of Eichwald et al.

SUMMARY OF THE INVENTION

It has been found that the effective pore structure of certain activated carbons may be modified so that menthol or other smoke-flavoring agent subsequently impregnated thereon will be, first, largely retained on the carbon during the period of shelf life, and second, efficiently and uniformly released during the smoking process.

The effective pore structure of the activated carbon with reference to menthol or other smoke-flavoring agent is that portion of the total pore structure of the activated carbon which is capable of attracting and holding, that is, of adsorbing the menthol or other smoke-flavoring agent. In accordance with theories proffered by Polanyi and others, the adsorption potential or intensity of attraction in such an effective pore structure diminishes rapidly with distance. Thus, molecules entering pores of small dimensions are held by attractive forces radiating inward from all sides. In pores of larger dimension the adsorbed molecules lose contact with the sides of the pores and, as a consequence, are held less firmly. The ultimate physical makeup or conformation of the pores or pore structure of a typical activated carbon has never been clearly established. However, the behavior of the pores or pore structure is such that a useful model of such pores in the abstract can be derived. Thus, all of the effective pores may be viewed, in the way of an abstract composite, as essentially concave in nature. The total pore structure comprises, consequently, larger apertures or macropores, and smaller size apertures or micropores. In the composite model these various sizes of pores are represented by the successively diminishing apertures of the concave pore having essentially a conical form, as one moves from the largest opening at the base into the diminishing interior volume toward the apex of the conical pore. Any activated carbon will thus be characterized by a pore size distribution.

Treating the present invention in light of the above, it is considered that the menthol or other smoke-flavoring agent will tend to be held more firmly in the smaller pores of a certain minimum aperture dimension, and less firmly in the pores of larger dimension. The pore-modifying agent of the present invention, which is added to the activated carbon prior to addition of the smoke-flavoring agent, will occupy and thereby occlude the smaller pores which comprise the most retentive portion of the effective pore structure of the activated carbon with respect to the smoke-flavoring agent. The pore-modifying agent is adsorbed in preference to the smoke-flavoring agent with which the activated carbon is later impregnated. Upon subsequent addition of the smoke-flavoring agent, the said agent will occupy, that is, be adsorbed by only that portion of the effective pore structure not already occupied by the pore-modifying agent previously impregnated into the activated carbon. This remaining portion of the effective pore structure is the less retentive portion consisting primarily of the larger dimension pores. In this way an activated carbon impregnated with smoke-flavoring agent is provided which possesses improved shelf life and delivery rates. Nevertheless, there is no intention to be bound by or limited to such theories herein, since the present invention is amply described hereinafter with respect to the manner in which it may be carried out.

As will be appreciated, the pore-modifying agent must not be incorporated in the activated carbon in such amounts as to block all of the effective pore structure. When the menthol or other smoke-flavoring agent is then introduced into the carbon, it will occupy, to the extent of the amount added, the remaining menthol-carrying or other-flavoring-agent-carrying pore volume of the activated carbon not previously blocked by the pore-modifying agent. The amount of menthol or other smoke-flavoring agent added to the activated carbon should be from about 0.2 percent to about 20 percent by weight of the original activated carbon weight prior to addition of the pore-modifying agent. Preferably, the smoke-flavoring agent is added in an amount of from about 2 to about 10 percent by weight. Consequently, the amount of pore-modifying agent which may be added to the activated carbon is limited by the amount of smoke-flavoring agent which is subsequently to be impregnated into the same carbon. Thus, the pore-modifying agent is added to the activated carbon in amounts up to from about 99.8 percent to about 80 percent by weight, and preferably up to from about 98 percent to about 90 percent by weight of the original weight of activated carbon. However, ordinarily the amount of pore-modifying agent employed will be considerably less than such maximum amounts, and is preferred to be in the range of from about 1 percent to about 40 percent, most preferably from about 5 percent to about 30 percent by weight of the original weight of activated carbon. There are minimum requirements, as well, for the amounts of pore-modifying agent to be added to the activated carbon. The amount added must be such that the pore-modifying agent wll occupy at least about 50 percent of the pore volume and at least about 60 percent of the surface area of the activated carbon prior to the introduction of menthol or other smoke-flavoring agent.

The pore-modifying agent of the present invention may be, generally, any material capable, as hereinabove described, of occupying and blocking the most retentive portion of the effective pore structure of the activated carbon, by being adsorbed and retained by the activated carbon in preference to the smoke-flavoring agent with which the activated carbon is subsequently impregnated. Suitable pore-modifying agent materials are preferably organic compositions. While inorganic salts such as sodium chloride and alkali metal and alkaline earth metal carbonates may be employed, it has been found that such materials may tend to migrate to the surface of the activated carbon granules after impregnation. Any material employed as a pore-modifying agent must not be a solvent for menthol or other smoke-flavoring agent to be employed. In addition, the pore-modifying agent should not be soluble in the particular solvent system employed to incorporate the menthol or other smoke-flavoring agent when it is later added to the activated carbon. For example, where menthol is employed as the smoke-flavoring agent and is incorporated in the activated carbon by means of an ethanol solution, the pore-modifying agent which is utilized should not be soluble in ethanol. Suitable materials may be solids or liquids, although solids are preferred. Any material employed must, of course, be toxicologically acceptable for use in a tobacco smoke filter. A particularly preferred material for use as the pore-modifying agent of the present invention is any member of the group of saccharides or sugars, for example, pentose and hexose monosaccharides such as glucose, and disaccharides, especially sucrose. Other oligosaccharides, and low molecular weight polysaccharides would also be useful.

The pore-modifying agent of the present invention may be introduced into the activated carbon in any known manner suitable for that purpose. For example, an aqueous or other solvent solution of the pore-modifying agent may be sprayed onto the activated carbon, or the activated carbon may be immersed in the solution. The activated carbon thus treated is then dried by conventional means, usually at a temperature of from 80° to 100°C. However, where the pore-modifying agent employed is a sugar, higher temperature drying should be avoided in order to prevent degradation or decomposition of the sugar.

The activated carbon substrate employed in the present invention may vary according to the ultimate use desired. For example, the total weight of smoke to be mentholated is much less in a cigarette than would be found in mentholated cigars of the type which are currently marketed. Accordingly, the activated carbon chosen for a cigarette filter need have comparatively little pore volume to accomodate the necessary menthol, but activated carbons with greater menthol-carrying or other-smoke-flavoring-agent-carrying pore volume would probably be preferable for cigars to minimize the volume of activated carbon necessary for the purpose. The activated carbons preferred for use in the present invention have the following characteristics prior to addition of the pore-modifying agent:

| | |
|---|---|
| Carbon tetrachloride activity Weight percent | 10 – 90 |
| Iodine No., mg/g | 400 – 1400 |
| Apparent density, g/cc | 0.3 – 0.8 |
| Particle size | As desired |

Menthol or other smoke-flavoring agent can be applied to the activated carbon previously treated with pore-modifying agent in several ways, performance of the ultimate product being essentially independent of the manner of application. For example, menthol can be liquefied by heating past its melting point and sprayed directly on the carbon. Similarly, a concentrated solution of menthol in a solvent, ethanol being the preferred solvent, can be sprayed on the activated carbon with the solvent vapors being allowed to dissipate preferentially due to their lower boiling points. A third and preferable way is to meter menthol crystals or liquid into the activated carbon previously treated with pore-modifying agent without necessarily spraying or otherwise attempting highly intimate mixture, then allowing the menthol vapor pressure to eventually distribute the menthol equally across the activated carbon in a closed container. In practice, this technique can be accomplished quite rapidly with the warm activated carbon obtained immediately after drying following impregnation with a solution of pore-modifying agent.

After impregnation with the pore-modifying agent, for example sucrose, the activated carbon should fall within the following ranges of characteristics:

| | |
|---|---|
| Carbon tetrachloride activity Weight percent | 1 – 40 |
| Iodine No., mg/g | 100 – 800 |
| Apparent density, g/cc | 0.4 – 0.9 |
| Particle size | As desired |

The present invention will be better understood from the following example, which is presented by way of illustration only.

EXAMPLE 1

Two samples of AFC 2204 activated carbon, a 14 × 40 mesh carbon having a virgin carbon tetrachloride adsorption value of 22.5 percent and iodine number of 610, available from Pittsburgh Activated Carbon Division of Calgon Corporation, were impregnated by immersion with equal volumes of sucrose solutions of 5 percent and 3 percent by weight concentration, respectively. The drained and dried activated carbons had apparent density increases of approximately 10 percent and 6 percent, respectively. Respective carbon tetrachloride values for the sucrose impregnated materials were 4.3 and 6.7 percent. Menthol was then added by equilibration in a desiccator at 100°C., the amounts of menthol pick-up later being computed at approximately 5 and 6 percent by weight, respectively, based on the combined weight of the carbon and sucrose.

After 18 days of storage, cigarettes made with filters containing the impregnated activated carbon as described above were smoked in a test device and the delivered menthol was determined. According to standard test procedures, only about one-fourth of the total smoke generated was "inhaled" and this was the portion analyzed for menthol. The samples were divided into two portions, one of which was smoked with the previously attached filter removed. The menthol delivery in this case would correspond to the amount of menthol which had migrated to the tobacco during the storage period. The menthol delivery in the samples tested with filter attached then represents menthol which had either passed through the filter, having previously migrated to the tobacco, plus that which was desorbed from the filter during the test. Menthol deliveries are expressed in milligrams per cigarette, based on a total of 8 puffs of 35 ml. each, at the rate of one puff per minute. The results obtained are illustrated below.

| Carbon | Without Filter | With Filter |
|---|---|---|
| From 5 percent sucrose solution | 0.39 | 0.46 |
| From 3 percent sucrose solution | 0.42 | 0.55 |

For this particular cigarette, analysts set 0.25 and 0.50 as ideal deliveries without and with filter, respectively. It can be seen that the 3 percent sucrose solution sample was slightly above this ideal in both respects. An equivalent test with AFC 2204 without sucrose showed that essentially no menthol was delivered. Further tests with sucrose impregnated AFC 2204 showed that addition of menthol by this technique was at least 35 percent more effective, comparing the ratio of menthol delivered to the menthol added, than adding menthol to tobacco, and vastly more effective than adding menthol to a non-modified carbon.

The present invention may be practiced by using smoke-flavoring agents other than menthol or in combination with menthol. However, the menthol or other smoke-flavoring agent must be placed on the activated carbon which has been previously impregnated with a solution of sucrose or other pore-modifying agent. Examples of additional smoke-flavoring agents are various "essential oils" making up flavors in the mint family, citrus and other fruit flavors, eucalyptus and other oils, and traces of materials which in higher concentration would be considered undesirable since they contribute bite, pungency, astringency, etc. Any type of filter may be made using the activated carbon prepared as described above. The carbon may be interspersed in a base of primarily cellulosic filter material, or may be bonded into a filter shape with a small amount of adhesive or thermosetting or thermoplastic resin.

What we claim is:

1. An improved granular activated carbon cigarette filter comprising granular activated carbon having an effective pore structure impregnated with a smoke-flavoring agent wherein the improvement consists of granular activated carbon in which at least about 50 percent of the pore volume and 60 percent of the surface area is blocked by impregnation with a non-toxic pore-modifying agent which is adsorbed and retained by the effective pore structure of the activated carbon in preference to the said smoke-flavoring agent with which the carbon is subsequently impregnated, provided, that the total amount of pore-modifying agent employed does not occupy all of the effective pore structure, but is such that sufficient effective pore structure remains for occupation by the subsequently impregnated smoke-flavoring agent; and in which the said smoke-flavoring agent occupies, to the extent of the amount thereof added, the remaining effective pore structure, that is, smoke-flavoring agent-carrying pore volume of the activated carbon not previously blocked by the said pore-modifying agent.

2. A cigarette filter as in claim 1 wherein the non-toxic pore-modifying agent is a sugar.

3. A cigarette filter as in claim 1 wherein the non-toxic pore-mofifying agent is sucrose.

4. A cigarette filter as in claim 1 wherein the smoke-flavoring agent is menthol.

5. A cigarette filter as in claim 1 wherein the smoke-flavoring agent is present in an amount of from about 0.2 to about 20 percent by weight based on the weight of the granular activated carbon.

6. A cigarette filter as in claim 5 wherein the non-toxic pore-modifying agent is sucrose.

7. A cigarette filter as in claim 5 wherein the smoke-flavoring agent is menthol.

8. A cigarette filter as in claim 1 wherein the pore-modifying agent is present in an amount of from about 1 percent to about 40 percent by weight based on weight of the granular activated carbon.

9. An improved granular activated carbon menthol cigarette filter comprising granular activated carbon having an effective pore structure impregnated with about 0.2 to about 20 percent by weight of the granular activated carbon of menthol, wherein the improvement consists of granular activated carbon in which at least about 50 percent of the pore volume and 60 percent of the surface area is blocked by impregnation with sucrose which is adsorbed and retained by the effective pore structure of the activated carbon in preference to the said menthol with which the activated carbon is subsequently impregnated, provided, that the total amount of sucrose employed does not occupy all of the effective pore structure, but is such that sufficient effective pore structure remains for occupation by the menthol; and in which the said menthol occupies, to the extent of the amount thereof added, the remaining effective pore structure, that is, menthol-carrying pore volume of the activated carbon not previously blocked by the said sucrose.

10. A method of preparing an improved granular activated carbon cigarette filter having an effective pore structure containing a smoke-flavoring agent comprising:

a. first impregnating the granular activated carbon with a non-toxic pore-modifying agent which will be adsorbed and retained by the effective pore structure of the activated carbon in preference to the said smoke-flavoring agent with which the activated carbon is subsequently impregnated, to the extent that at least about 50 percent of the pore volume and 60 percent of the surface area of the activated carbon is blocked by the said pore-modifying agent, provided, that the total amount of pore-modifying agent employed does not occupy all of the effective pore structure, but is such that sufficient effective pore structure remains for occupation by the subsequently impregnated smoke-flavoring agent; and b. subsequently impregnating the granular activated carbon impregnated with pore-modifying agent with the said smoke-flavoring agent to the extent that it occupies, to the extent of the amount thereof added, the remaining effective pore structure, that is, smoke-flavoring-agent-carrying pore volume of the activated carbon not previously blocked by the said pore-modifying agent.

11. The method of claim 10 wherein the smoke-flavoring agent is employed in an amount of from about 0.2 to about 20 percent by weight based on the weight of the granular activated carbon.

12. The method of claim 10 wherein the pore-modifying agent is present in an amount of from about 1 percent to about 40 percent by weight based on weight of the granular activated carbon.

13. A method of preparing an improved granular activated carbon cigarette filter having an effective pore structure containing menthol smoke-flavoring agent comprising:

a. first impregnating the granular activated carbon with sucrose to the extent that at least about 50 percent of the pore volume and 60 percent of the surface area of the activated carbon is blocked by the said sucrose, provided, that the total amount of sucrose employed does not occupy all of the effective pore structure, but is such that sufficient effective pore structure remains for occupation by the menthol; and b. subsequently impregnating the granular activated carbon impregnated with sucrose with menthol in an amount of from about 0.2 to about 20 percent by weight of the granular activated carbon.

* * * * *